United States Patent [19]

Hechler, IV

[11] 4,174,812

[45] Nov. 20, 1979

[54] JET PUMP PROPORTIONERS

[76] Inventor: Valentine Hechler, IV, 26 Meadow View Rd., Northfield, Ill. 60093

[21] Appl. No.: 873,677

[22] Filed: Jan. 30, 1978

Related U.S. Application Data

[63] Continuation-in-part of Ser. No. 716,896, Aug. 23, 1976, abandoned.

[51] Int. Cl.[2] ..... B05B 7/30

[52] U.S. Cl. ..... 239/318; 239/427.3

[58] Field of Search ..... 239/310, 318, 417, 427.3, 239/427.5, 407, 579; 222/129.2, 133

[56] References Cited

U.S. PATENT DOCUMENTS

| | | | |
|---|---|---|---|
| 3,071,018 | 1/1963 | Mullick | 239/318 |
| 3,473,481 | 10/1969 | Brane | 239/310 |
| 3,863,843 | 2/1975 | Hechler | 239/318 |
| 3,942,724 | 3/1976 | Mocarski | 239/417 |

*Primary Examiner*—Robert W. Saifer

*Attorney, Agent, or Firm*—Watson D. Harbaugh

[57] ABSTRACT

A jet proportioning and liquid mixing pump system having one or preferably more than one proportioning stages with the first stage operating at a low ratio below 1 to 5 to minimize degradation in which solvent under kinetic flow energy initially mixes with free flowing solute at substantially environmental pressure to prevent vaporization effects upon the solute, and, controlling the desired ultimate ratio with high accuracy by either varying the effective flow area of the solvent flowing under kinetic energy in a final mixing zone, or varying the mixer induced output pressure upon the mixture as it leaves a mixing stage after the kinetic flow energy in the mixture therefor has been converted to pressure flow to maintain a positive pressure upon the solute at the proportioning stages.

13 Claims, 5 Drawing Figures

JET PUMP PROPORTIONERS

BACKGROUND OF THE INVENTION

As pointed out in said Hechler patent, the proportioning of a miscible solute in a water solvent under continuous flow in a low-cost conventional system encounters objectionable ratio variations because of variations in viscosity or in either the pressure of solvent supply, or the lift height of the solute supply the latter being either a positive or negative gauge pressure. In an endeavor to cope with these discrepancies generally referred to as ratio degradations the conventional practice, particularly with portable units, has predominantly been the use of either one of two single stage designs that are related to the relative pressure of the solute at the mixing chamber, both having their advantages and disadvantages.

In one of the designs a high vacuum, metered solute flow system is used which develops a high vacuum condition approaching zero pounds per square inch absolute (p.s.i.a.) upon the solute for metering the solute through a flow restriction at the mixing chamber level. This results in a high vacuum effect in the mixing chamber, which not only reduces the flow significance of solute lift height pressure variations on the solute supplied at the metering flow restriction but prevents ratio accuracy in the use or application of hot solutes in mixing chambers, the solutes vaporizing at the flow restriction with the pressure drop that is due to restricted flow.

Also, in the high vacuum metered solute flow system the vacuum is related to the pressure of the environment and the ratio proportioning in the first stage is adversely affected by variations in solvent pressures. Also, at higher ratios the restriction opening becomes so small as to readily become clogged and at low ratios the difficulty of maintaining a high vacuum renders this type of metering impractical.

In the other single stage design, having a low vacuum free solute flow system is provided in which the pressure acting upon the solute in the confluence chamber essentially differs only by the free-flow low vacuum lift height and vaporization or boiling point variations of the solute. Proportioning is essentially independent of variations in solvent pressure but varies with solute lift heights. Also, at higher ratios there is a greater difficulty of providing and maintaining the ratio proportioning relationship between inlet and outlet ports of the mixing chamber.

Either system can be quite accurate for certain ratios at the exact solute and solvent pressures and temperatures designed for the ratio provided their relationship then remains constant. However, only a small percentage of the commercial market would be satisfied with certain ratios and degrees of accuracy. The danger of improper solution ratios still confronts most of the users since standard concentrates are supplied and solvent pressures available significantly vary quite widely. Thus, at ratios which are available and the degradations conventionally tolerated therewith, the solute metered flow system is generally used as limited to ratios above 1 to 10 and a free-flow solute system is limited to ratios below 1 to 24.

Two-stage conventional high vacuum gap proportioners may provide a better pressure output efficiency, but solute temperatures are sometimes critical and performance is no better than single-stage proportioners with respect to ratio variations occurring in both stages.

SUMMARY OF THE INVENTION

The Hechler invention referred to above provides a mathematically standardized, low-cost, portable continuous proportioning-mixing dispensing procedure and system controlled by the actual ratios of the flow port areas for a wide range of solvent pressures for use in mass produced proportioners that deliver a predictably accurate wide range of ratios generally well within a variation of plus or minus 5%. It contemplates a free open flow of solute through a supply conduit with a solute level that may be lifted or dropped a few feet, throughout a substantially complete range of usable ratios including a high ratio range which economizes on solute container sizes and costs for concentrated solutes; and, it performs thusly over the expected range of municipal water supply pressures above a low pressure that is selected as adequate for dispensing and ecologically safe against possible backflow contamination of the water supply.

Although ratio accuracy is substantially improved with multiple flow proportioning mixers connected in series, it has been found that stability and ratio constancy of dispensing conditions are greatly improved where mixing stages are provided in series relation with the resulting pressures and the mixing chambers of downstream stages operating under positive gauge pressures, and the final discharge or nozzle opening is generally a little less in flow area than that of the output opening of the final mixing stage thereby maintaining working pressures at the ratio proportioning orifices that prevent vaporization of solute or solvent and degradation of the mixture ratio.

Each mixing stage of the invention basically comprises low ratio mixing zones at the confluence between a free-flowing solute and a jet of solvent having kinetic energy that entrains the solute and ejects the mixture coaxially through a mixer stage outlet port. In brief, a converging wall nozzle having a jet port opening into the confluence zone accepts solvent under pressure and converts the pressure to kinetic energy for the jet stream, and, the outlet port having a larger flow area receives and proportions the solute and solvent therethrough in relation to the differential in their flow areas. The outlet port generally leads to a diverging wall passage which converts the kinetic flow energy in the mixture back to pressure.

For ratio accuracy in a mixing zone, the pressure of a mixture leaving said zone should be at the same pressure as that of the solute entering the mixing zone through the inlet opening and this effectively maintains the liquid status of the mixture components and the mixture for ratio accuracy and presurized dispensing.

Considering a mixing stage having a solute supply which passes through a port along with solvent into a mixing zone which mixes and converts kinetic energy to pressure, then for ratio accuracy in a mixing zone, the pressure of a mixture leaving said zone should be the same pressure as that of the solute entering the mixing zone as it enters the solute port.

At the first stage, such pressure is the environmental pressure in normal use, but may vary some with solute lift height. When the mixture from the first stage is used as solute in a subsequent stage, the mixing zone pressure is the output pressure of the preceding stage. With the implementation of these conditions, the mixture ratio provided at any mixing zone is related to the ratio of the flow areas of its solvent jet inlet and solution outlet ports.

It has been found that where a solute is supplied under a substantially constant gauge pressure to a mixing zone of any subsequent stage, any possible ratio variations that might occur in the first stage that would affect the ultimate mixture ratio attained can be corrected to assure ultimate ratio accuracy by adjustably varying the relative effects of certain flow areas, namely, either reduce the flow area of the solvent inlet port to the final stage mixing zone, or reduce the area of the discharge nozzle port following the final mixing stage. It is preferred to design a low ratio in the final mixing stage and varying the flow area of the solvent stream entering the mixing chamber outlet port by a longitudinally adjustable tapering pin being advanced from within the converging walls leading to the solvent jet port. This accomplishes a variable mixture ratio reduction or solution enrichment. Reducing the flow area of the discharge nozzle opening reduces the solution enrichment, i.e., increases the ratio.

In varying the discharge nozzle outlet after the solution has had its kinetic energy converted to pressure provides a back flow pressure on solute mixtures throughout the system, as distinguished from any effect upon the kinetic flow energy of solvent entering the mixing zones, and thereby increases the ratio. Accordingly, a high accuracy of a ratio selected for that stage can provide a relatively wide range of ratios which include the initially designed ratio.

DESCRIPTION OF THE PREFERRED EMBODIMENTS

Figures 1, 2, 3, 4, 5:
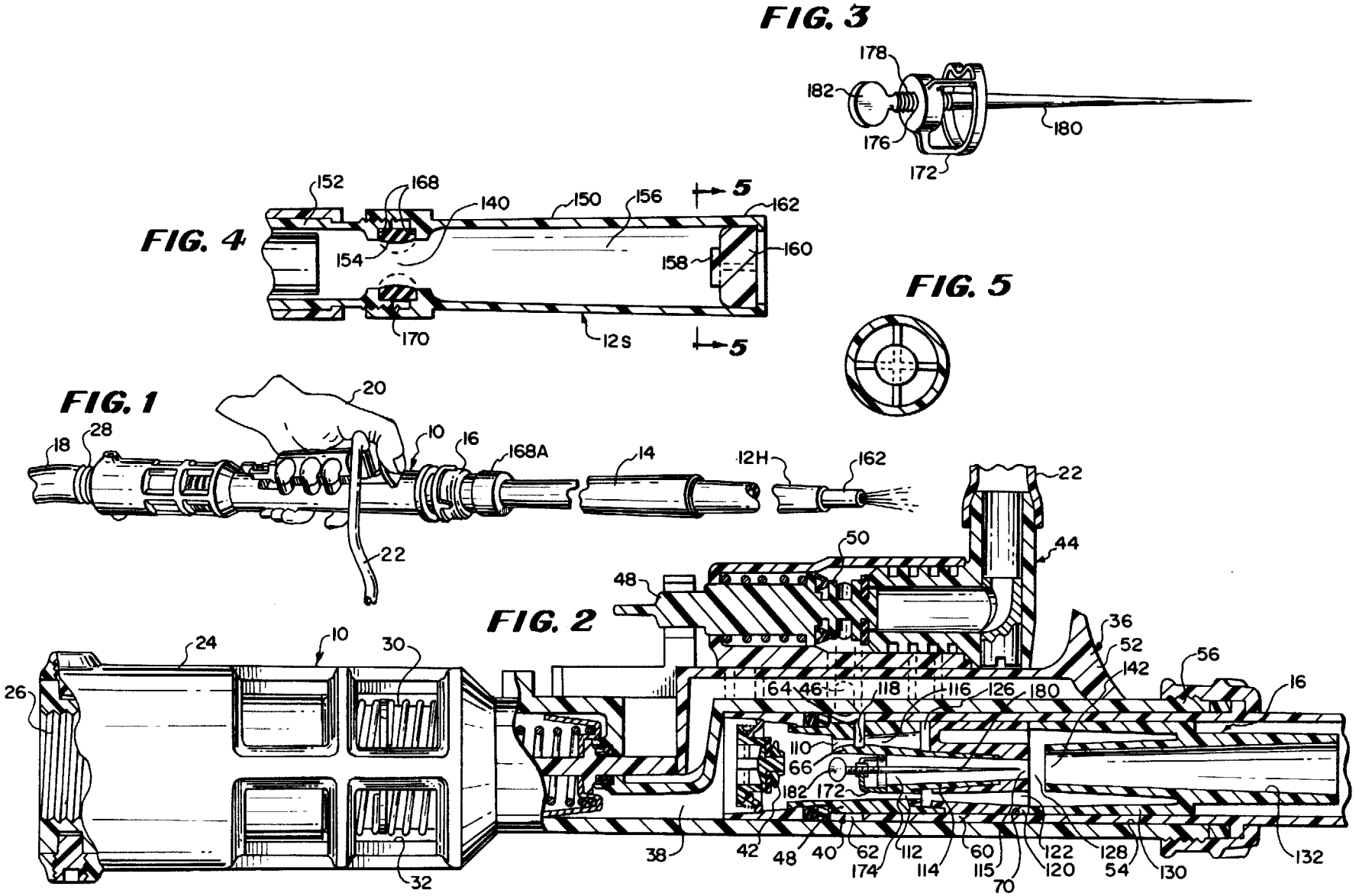
FIG. 1 is a perspective view of the device embodying the invention as manipulated in use and operation.
FIG. 2 is an enlarged perspective view of the mixing device and mixer constructions with the manually controlled parts therein in no-flow positions.
FIG. 3 is a perspective illustration of a construction employed in the invention for controlling ratio by varying the solvent flow rate to a mixing chamber, preferably the last stage thereof.
FIG. 4 is a sectional view of another embodiment of the invention for the soft-flow discharge of the mixture and for controlling ratio by varying the back pressure on the mixture at the outlet of the mixing device and is basically capable of a hard-flow discharge of the mixture but modified.
FIG. 5 is a sectional view taken on line 5—5 in FIG. 4.

It has been found that hard-flow nozzles of different flow outlet sizes provide different solution ratios that are quite stable where the flow characteristics ahead of, or in the nozzle such as the nozzle discharge opening, operates to provide a related size or effect of the pressure upon the output of the final mixture stage within usable limits. It can be used to correct any deviation from the designed ratio encountered in the preceding stages of the proportioning mixer, particularly the first stage where it is most likely to occur. Increasing the back pressure partially obstructing solvent inflow to, or decreasing the effective solute overflow area from, the final mixing zone provides a ratio adjustment control.

The invention will be described in further detail, by way of example, as related to the proportioning, mixing and dispensing of municipal water under pressures of 15 to 100 p.s.i.g. serving as a solvent, and a chemical concentrate liquid serving as a solute having a free open flow that is subject only to minor gravity influences, or viscosity changes either positive or negative, if at all.

The mixture is dispensed from a gun 10 under pressure through either one of two types of nozzles 12H or 12S, for a hard-flow discharge or soft flow, respectively, with or without an extender conduit 14 between the nozzle 12 and the proportioning-mixer 16. The extender conduit can itself be used to vary the mixture ratio which can be adjusted by a pin in the preceding solvent inlet opeining to provide the correct ratio.

The invention is illustrated as part of a manually controlled automatically vented proportioner-mixer-dispenser gun 10, such as illustrated in Hechler U.S. Pat. No. 3,862,640, connected to the outlet of a garden hose 18 to utilize municipal water as the solvent having a working pressure around 40 p.s.i.g., and the mixture is dispensed from the other end of the gun 10 as controlled by a person 20 holding and manipulating the gun to which a solute is connected through a free-flowing tube 22.

SOLVENT SUPPLY AND FLOW CONTROL

The inlet end of the housing 24 has a threaded opening 26 preferably mating only with an outlet male fitting 28 conventionally provided on the garden hose 18 for dispensing municipal water. The solvent flow control and low positive gauge pressure venting is more particularly described in said Hechler U.S. Pat. No. 3,984,053.

Briefly, referring to FIG. 2, the gun 10 provides an anticontamination venting chamber 32 protecting a portable water supply in which manual control of the flow of solvent through the compartment is provided by a valve arrangement 30 manually operated by an actuator 36 for a constant wide open flow of solvent through the passage 38 to the mixer 40 through a back flow check valve 42.

SOLUTE SUPPLY

A solute supply is designed for wide open flow through the tube 22 and could lead directly to the mixing zone inlet opening 46. It is preferred to valve the solute selectively ON or OFF but substantially simultaneously with water. This is accomplished through a mechanical connection 48 actuating the solute valve 50 that is located on top of the housing 16 to the rear of the thumb handle 52. It interengages with the manual actuator 36 when solute is used.

During the mixing operation, with the solute and solvent valves open, the free-flowing solute is under approximately zero gauge pressure during mixing and when the solute valve 50 is open, it is desired that the solute flow as freely as the solvent can ingest it. When closed, the solute trapped beyond the valve 50, being totally liquid without any expandible media being present, will not respond to any aspirating effect or vaporization nor lose prime.

PROPORTIONING AND MIXING

The housing 24 provides a proportioning mixing chamber 54 adjacent to its outlet end 56 which receives solvent from the main valve 30 and solute through the opening 46 in the side wall thereof. The mixer-proportioner unit 16 received in the mixing chamber 54 is illustrated as a three-stage device and comprises an outer shell 60 and mixing stage inserts (FIG. 2). Adjacent the inner end of the shell an external circumferential groove 62 is provided for coincidence with the opening 46 in the housing and has an opening 64 from the groove to the interior of the shell 60 for flow of solute to the primary stage 66 of the proportioner-mixer assembly of elements in sealed relationship in any relative rotational orientation.

The invention is illustrated with three inserts collectively providing three interrelated stages permuted from a selection of defined different mixing zone inlet and outlet port sizes and for substantially different but determined output ratios. The upstream element 48 (FIG. 2) forms the converging wall nozzles 110, 112 and 114 of all three stages and the diverging wall energy converter 116 of the first stage with the confluence gap or mixing zone 118 therebetween in communication with the opening 46 to introduce the solute. The third stage nozzle 114 is axially located while the first stage nozzle 110 and diverging wall energy converter 116 are located laterally thereof on one side and the second stage nozzle 112 is divided into several nozzles located on the other side of and spaced around the third stage nozzle 114.

The intermediate element 120 centrally telescopes over the third stage nozzle 114 and provides the second stage mixing zone with diverging wall energy converters 120 disposed in alignment with the second stage nozzles 112 and provides an axial space between the elements which serves collectively as an outlet chamber 126 for the first stage confluence mixing zones 118 and for the second stage nozzles.

The final stage element 130 provides the diverging wall energy converter and mixing zone 132 of the third stage nozzle. It is disposed in axial alignment with its nozzle 114 and is spaced therefrom to provide a confluence zone space 128 that receives the output from the second stage mixer 122 and supplies it as a solute to the confluence zone 128 of the third stage mixer 132.

In manufacture, the triple mixer-proportioner lends itself for quick changes from one set of ratios to another merely by changing needle sizes in the cores, or, by not using needle to form the nozzle of any one of the mixer stages if only a two-stage pump is designed.

For example, with a two-stage free-flowing solute system, the relative diameters of the port flow areas may be as follows for an overall ratio of 1:24 and rate of flow at 6 gallons per minute of water as a solvent:

| | Zone Inlet Port | Zone Outlet Port |
|---|---|---|
| First Stage | .0664" | .1713" (1:3) |
| Second Stage | .0885" | .2056" (1:8) |

Also, by way of example, but not limitation, the relative diameters of the port flow areas for a free-flowing solute system are as follows for an overall ratio of 1:64 and rate of flow at 6 gallons per minute of solvent at 40 p.s.i.g.:

| | Zone Inlet Port | Zone Outlet Port |
|---|---|---|
| First stage | (155) .0395 D | (157) .0527 D (1:4) |
| Each of 3 second stages | (163) .0582 D | (165) .0776 D (1:4) |
| Third stage | (173) .1996 D | (175) .2677 D (1:4) |

Rate of flow is related to solvent pressure. The relative sizes of the inlet and outlet ports of the stages determine the ratio, their overall sizes the rate of flow. Preferably, the first stage is less than 1 to 5 and if the ultimate ratio is above 1 to 4 ratio (20%) solution, the overall system ratio is divided up between the other stages in such a way that the first stage ratio resides in that range where there is minimum degradation. Thus, a minimum degradation for the overall system is attained. This essentially relates the elements of the invention and ultra high ratios may be provided.

For example, if a 1 to 16 system ratio is desired and a single stage 1 to 16 proportioner is used, degradation is based upon 1 to 16. If a two-stage system is used and is divided arbitrarily on a 1 to 4, 1 to 4 basis, which still provides 1 to 16 overall, the degradation of the first stage would then be based on the 1 to 4 ratio rather than the 1 to 16. This essentially cuts down the degradation of the overall system. The first stage isolates the following stages with respect to degradation and knowing the degradation of the first, the second stage can be appropriately designed.

The importance of this system is noted when compared with a single stage 1 to 16 system that might have a degradation of plus or minus 20% for a given lift height change. By using the two-stage system this is cut down to only plus or minus 5% for the same lift height change. The two stages have reduced that which may be intolerable 20% to a possible 7% variation for which correction can easily be provided in the invention.

In the present invention, this remaining degradation is substantially eliminated over a ratio range of approximately 200%.

In implementing the concept of the invention, it may be noted that pressure upon imcoming solvent is converted to kinetic flow energy as it flows into the mixing chamber and whatever pressure there is on the solute becomes essentially the pressure in the mixing chamber. If the kinetic flow energy is never reconverted to pressure, the ultimate pressure upon the mixture varies, even if it passes through several mixing chambers, and the unit will not act as a predictable proportioner.

Also, if there is to be any pressure established on the resulting mixture, the kinetic flow energy must be reconverted to pressure in whole or in part. This is done by conducting the mixture from the mixing chamber outlet through a progressively enlarging passage and the pressure thus established becomes the solute pressure in the next mixing chamber.

In order to provide and maintain liquid stability for accurate proportioning in all applications including hot solute mixtures, a working back pressure is preferably established upon the final mixture output to relate all stages and prevent vapor cavitation. If the first stage output pressure is to provide a hard flow from a nozzle, diverging walls of the enlarging passages are designed in a well-known manner to optimize the pressure upon the mixture for use as the solute in the next stage to establish higher pressures in succeeding mixing zones as in an applicator. The final output pressure can be mechanically handled if the final flow is to be a soft flow as in a dispenser.

It should also be noted that the confluent liquids are directed through substantially short cylindrical openings defining the ports having flow areas larger than the respective solvent nozzles in the ratios that produce the ultimate proportioning desired. The ports need not be cylindrical but are more easily produced. They have the least surface friction and are more enduring to preserve their size against erosion, particularly in outlet ports of mixing chambers. The jetting water molecules freely and fully transfer kinetic flow energy in proportion in their jet strength to entrain molecules of the solutes in the mixing zones and the diverging walls convert energy in relation to the differential in the relative sizes of the inlet and outlet ports thereof to mix the confluent liquids.

MIXER ACTION

Where the solute can or does flow freely to a mixer chamber regardless of the pressure thereon, there is very little degradation of the mixture ratio unless the solute pressure is below the environmental pressure (atmosphere) in a mixing chamber, or the pressure upon the mixture leaving the last stage drops enough to reflect back upon the mixing chamber as where the discharge nozzle is too large.

In the present invention, contrary to the practice in conventional single stage mixer-proportioner, the dispensing opening 140 may be equal in flow area to the last stage outlet port 142, and within substantial tolerances can be safely less to improve jet discharge up to but not beyond the point where the equalization of solvent and solute mixture pressure is disturbed in the zone 142 of the last stage.

DISCHARGE NOZZLES

The discharge nozzles 12 interchangeable associated with the flow areas of the mixer proportioners described are, as already noted, of two types, soft flow 12S and hard flow 12H. In the soft flow, a substantially cylindrical housing 150 is provided with a male joint member 152 having the converging throat dispensing opening 154 with a flow area related to that of the mixer thrid stage outlet port flow area 140 which directs a discharge stream axially through a zone 156 against a target 158 (FIG. 2) supported on cross-members 160 at the outlet 162 at the end of the housing 150. The target 158 can be removed and the nozzle becomes a hard-flow nozzle. Thus, the hard-flow nozzle 12H may terminate just beyond a dispensing opening 140, but preferably comprises an exchangeable tip 162 to provide the appropriate flow area and rate of flow for a jet stream, a fan, or a spray, each having a discharge flow area coacting with and somewhat smaller than the flow area of the proportioning mixer outlet port 142 for mixture ratio stability.

FINE ADJUSTMENT OF SOLUTION RATIO

With solute freely entering a mixing zone in the invention the transfer of kinetic energy from the solvent to the solute provides the mixture that leaves that zone. When that transfer is accomplished entirely by kinetic action, and in no way involves pressure changes for the transfer of energy, there is no degradation in that zone from the design ratio. When pressure changes are involved as well as transfer by kinetic action it is then that ratio degradation occurs whether it be slight or otherwise.

In a three-stage mixer such as illustrated, if the ratio can be corrected ahead of the last stage, then a wider range of mixing ratios can be controlled and there would be little if any change of the velocity flow characteristics of the jet stream ultimately discharged from the final nozzle of the mixing device. On the other hand, a ratio adjustment located nearest to the final discharge outlet provides the greatest ratio accuracy in the final solution as far as adjustability is concerned.

In either case, within the limits discussed herein, the adjusted outlet size preferably is not greater than but preferably is less than, the outlet port size of the preceding mixing compartment. Moreover, with any given discharge nozzle whether it be a hard flow or a soft flow nozzle, a mixture ratio can be adjusted without change of final flow characteristics by an adjustment related to the solvent flow to the final mixing stage.

Also, with respect to effects related to pressure changes, it has been found that they can either be corrected for by adjustment of the size of the discharge opening that follows the final mixing zone or, better yet, by adjusting the inflow area of the solvent to the final mixing zone of a multi-stage mixer, or both, where an extension conduit 14 is used.

For the former, a nozzle 150 is provided for ratio adjustment which has a rated flow opening as at 140 (FIG. 4) that is approximately as large as the outlet port 142 (FIG. 2) of the final stage of the proportioner-mixer. This opening may be of simple construction wherein the cross-sectional flow area at 140 can be the opening of a rubber grommet 154 that can be varied by adjustably compressing the grommet in an axial direction between the opposing shoulders 168 at a threaded engagement 170 between the nozzle shell 150 and base 152 to reduce the flow area of its central opening 140 therethrough. The reduction may be accomplished as noted by axially compressing the grommet (FIG. 4); or by centrally garreting the rubber grommet 154 circumferentially to reduce in a radial direction the body portion defining the opening 140; or by an adjustable flow retarding obstruction (not shown) disposed in the nozzle. Restriction here increases the ratio or dilution with a back pressure effective back through the solute supply.

In the latter, as illustrated in FIGS. 2 and 3, the ratio may be adjusted at the solvent inlet port 70 to the final mixing stage space 128 in which a full flow spider support 172 is received over the inlet 174 of the nozzle 114 and preferably has a threaded central opening 176 in which the threaded shank 178 of a needle 180 is received with a handle 182 on its end which can be twisted to advance or retract the needle and thereby vary the effective solvent flow area of the nozzle at 115 without disturbing the kinetic energy flow of the solvent to the mixing zone 142. Reducing the flow area increases the concentration and decreases the ratio.

The needle preferably is tapered but need not be if small, and, it may be replaced by needles of different sizes for different fixed ratios, thereby providing a wide range of ratios with a minimized number of mixer units. Either the rubber grommet 154 or the needle 180, or both, may be employed.

What is claimed is:

1. A multi-stage solution proportioning, mixing and dispensing device for liquids comprising:

a housing having a pressurized solvent inlet, a solute inlet and a pressurized solution discharge opening having determined flow characteristics;

a plurality of mixing means between said inlets and said discharge opening, each mixing means defining a confluence chamber and mixing zone and having a nozzle receiving solvent under pressure from said inlet, each nozzle having converging side walls to convert pressure on the flowing solvent to kinetic flow energy and terminating in a jet flow port opening separately into the respective chambers, one of said port openings having fixed flow characteristics;

solute conduit means connecting the solute inlet to one of said chambers in free flowing relation;

conduit means conducting the mixture from said one of said mixing means as a solute to the chamber of the other mixing means including an outlet port from the one mixing means disposed in axial alignment with the solvent jet flow port thereto and having a diverging wall therefrom for converting kinetic flow energy of said mixture to pressure and conducting it to the chamber of the other mixing means;

further conduit means conducting mixture from said other mixing means to said discharge opening including an outlet port from the chamber of said other mixing means having a flow area not less than that of said discharge opening and being disposed in axial alignment with said one of said openings having fixed flow characteristics, and having a diverging wall for converting kinetic flow energy to pressure upon the solution flowing therethrough; and means axially adjustable in one of said converging wall nozzles for varying the flow characteristics of one of said fixed flow openings to provide a ratio correction for the mixture discharged from the discharge opening.

2. The device defined in claim 1 in which there is a third mixing means and a third conduit means intermediate and interconnecting said one mixing means and the other chamber.

3. The device defined in claim 1 in which said means for varying the flow characteristics is disposed at the solution discharge opening for applying and controlling the effective back pressure upon the solute entering said outlet port of said other mixing chamber to adjust the mixture ratio of the solution being discharged therefrom.

4. The device defined in claim 3 in which the means for varying the flow characteristics is a resilient member having a flow opening whose wall is radially adjustable.

5. The device defined in claim 1 in which said means for varying flow characteristics includes a flow restricting element mounting and a manual means axially adjustable at the wide end of one of said converging side wall nozzles in the path of solvent flow through the fixed flow opening.

6. The device defined in claim 5 in which said means for varying the flow characteristics is disposed in said converging side wall nozzles solvent opening is an adjustable mounted tapering needle valve member.

7. A multi-stage proportioning and mixing device for liquids in which any ratio degradation from a designed ratio is confined essentially to the first mixing stage operating at a low ratio below 1 to 5 with a free flowing solute;

a final stage low ratio mixing and dispensing means in which the mixture discharged under pressure from the preceding stage enters the mixing zone of the final stage at a positive pressure substantially equal to the pressure upon said mixture as it leaves the preceding stage and is discharging through an outlet opening;

means for discharging the final mixture under pressure from the final stage through a final discharge opening whose outflow area may be less but not greater than the flow area of the outlet opening from the final mixing stage; and means for varying the flow area of said final discharge opening to vary the back pressure upon the ultimate mixture before discharge and thereby vary the back pressure upon the solute entering the final stage for controlling the ratio of the solute to the solvent in the ultimate mixture to correct for any degradation in the first stage.

8. In a solution proportioning, mixing and dispensing device having a housing defining spaced solvent and solute inlet openings, a plurality of mixing zones each including a confluence chamber and a mixture discharge opening;

solvent conduit means connecting said solvent inlet opening to each of said mixing zones and having converging side walls to convert solvent pressure to kinetic flow energy for each of said mixing zones;

conduit means having a diverging wall converting kinetic flow energy to pressure flow connecting said one mixing chamber with another mixing chamber;

conduit means interconnecting said other mixing chamber and said mixture discharge opening including a diverging wall energy converter;

the relative flow area sizes between said respective solvent inlet openings and the mixture outlet openings determining the ratios of solute and solvent mixtures delivered from said mixing zones;

mixture discharge means having an outlet flow area not greater than that of the outlet opening to the last diverging wall to provide pressure stability on the final mixture; and means for varying the flow area of said mixture discharge opening to vary the back pressure upon the solute in said other mixing chamber.

9. In a liquid solution proportioning, mixing and dispensing device having a plurality of ratio proportioning stages in which the output mixture of one is used as the solute of the next and the ratios are collectively proportioned with the pressures at each confluence zone equal upon free flowing solutes entering the zones of each confluence and the pressure on the mixture as the mixture leaves the respective zone of confluence and including adjustable needle valve means in the last stage for applying and varying back pressure on a mixture leaving one of the respective zones of confluence.

10. In a solution dispensing, proportioning and mixing device having a housing defining a compartment with spaced solvent and solute supply openings and a discharge opening;

an interchangeable unit for proportioning, mixing and dispensing solutions of different ratios, comprising:

a shell releasably received in said compartment open at both ends and having a port through its wall in communication with said solute supply opening;

an upstream means in said shell defining a plurality of converging wall nozzles in communication with said solvent opening and terminating in jet ports for converting solvent pressure to flow energy and a diverging wall primary energy converter having an inlet port spaced from one of said jet ports and defining therebetween a primary confluence zone in communication with said solute port;

an intermediate means having a secondary diverging wall energy converter with an inlet port spaced from another of said jet ports and defining therewith a second confluence zone in communication with the outlet of said primary diverging wall energy converter;

a downstream means having an inlet port and a diverging wall energy converter spaced from the secondary energy converter forming another confluence zone;

said downstream means including a nozzle means connected to third stage diverging wall energy converter having a dispensing opening smaller in flow area size than the flow area of said downstream inlet port; and means for varying the back pressure upon one of the last two diverging wall energy converters to control the ratio of the solution dispensed from the dispensing opening of the third stage.

11. The multi-stage method of liquid mixing a solute with a pressurized solvent and dispensing the solution with the solvent pressure and controlling the ratio by the control of back pressure upon the solute after the first stage comprising;

converting pressure of flowing stream of solvent of predetermined cross-sectional flow area to kinetic flow energy in a primary mixing zone, transferring kinetic energy to a free flowing solute at substantially atmospheric pressure to form a flowing stream of primary solution of a larger flow area and converting the flow energy of the primary solution to pressure;

converting solvent pressure of a terminal flowing stream of solvent of predetermined cross-sectional flow area to kinetic flow energy in a final mixing zone and transferring therefrom kinetic flow energy to the solution of the preceding zone at approximately the pressure of said solution to form a final solution having a flow area larger than said flowing stream of solution and converting the kinetic flow energy thereof to pressure; and discharging the solution to a lower pressure environment through an adjustable opening having a maximum flow area as large as the last said larger flow areas varying within five percent the back pressure upon the solution of the preceding mixing zone.

12. The method of mixing and dispensing in claim 11 including converting solvent pressure of another flowing stream of solvent of predetermined cross-sectional flow area to kinetic flow energy in an intermediate mixing zone, transferring kinetic flow energy to said primary solution to form a further solution having a flow area larger that that of said primary solution and converting the kinetic flow energy thereof to pressure.

13. The process of concurrently flowing converging streams of distinctive liquids having different gauge pressures one of which is substantially zero gauge pressure and the other a higher pressure;

converting the higher pressure to kinetic flow energy for jet flow at the point of confluence;

mixing the liquids at substantially zero gauge pressure and converting kinetic flow energy in the mixture back to a positive gauge pressure in a diverging flowing stream;

converting said higher pressure of another stream of the higher pressure liquid to kinetic flow energy for jet flow at a point of confluence with said mixture flowing as a stream having said positive gauge pressure and mixing them at a positive gauge pressure to form a flowing stream of solution having a size-determined flow area and reconverting said kinetic flow energy of the solution back to gauge pressure;

confining said solution to a flowing stream, discharging the stream; and varying the back pressure upon the confined flowing stream of solution that is effective upon the solute entering the mixture at its point of confluence to control the mixture ratio of the solution at the point of confluence.

* * * * *